US006186135B1

(12) United States Patent
Harwath et al.

(10) Patent No.: US 6,186,135 B1
(45) Date of Patent: Feb. 13, 2001

(54) ARCHERY BOW STABILIZER

(75) Inventors: Frank A. Harwath; Robert S. Mizek, both of Downers Grove, IL (US)

(73) Assignee: New Archery Products Corp., Forest Park, IL (US)

( * ) Notice: Under 35 U.S.C. 154(b), the term of this patent shall be extended for 0 days.

(21) Appl. No.: 09/461,823

(22) Filed: Dec. 15, 1999

(51) Int. Cl.[7] ..... F41B 5/20
(52) U.S. Cl. ..... 124/89
(58) Field of Search ..... 124/89; 188/378

(56) References Cited

U.S. PATENT DOCUMENTS 4,570,608 * 2/1986 Masterfield ..... 124/89
5,016,602 5/1991 Mizek ..... 124/89
5,511,533 * 4/1996 Waller ..... 124/89
5,584,282 * 12/1996 McDonald ..... 124/89
5,735,257 * 4/1998 Walk ..... 124/89

* cited by examiner

*Primary Examiner*—John A. Ricci
(74) *Attorney, Agent, or Firm*—Pauley Petersen Kinne & Fejer

(57) ABSTRACT

A bow stabilizer having a hollow body with at least one opening and forming a chamber. A plug is removeably mounted within each opening. At least a portion of the plug is positioned between two contact surfaces of a sealing device. The sealing device further has a threaded member rotatably mounted with respect to the plug and mateably engageable with an internally threaded bore formed by a first plate of the sealing device. As the threaded member is rotated, the two plates of the sealing device move towards each other which compresses and deforms at least a portion of the plug. An outer surface of a portion of the plug is enlarged and compressed against an inner surface of the hollow body to form a tight seal that contains a fill within the chamber.

24 Claims, 7 Drawing Sheets

ARCHERY BOW STABILIZER

BACKGROUND OF THE INVENTION

1. Field of the Invention

This invention relates to a shock absorbing bow stabilizer that is mounted to an archery bow, for one reason to reduce recoil, shock, vibration and noise when an arrow is shot from the archery bow. More specifically, this invention relates to a shock absorbing bow stabilizer having a sealing device mounted with respect to a removeably mounted plug, preferably made of a resiliently deformable material, to sealably contain a liquid and/or a solid within a chamber of a hollow body of the shock absorbing bow stabilizer.

2. Description of Related Art

Various bow stabilizers and vibration dampeners have been developed to both balance and absorb shock when an arrow is shot from an archery bow. These conventional bow stabilizers generally have a hollow cylinder filled either with a viscous fluid or solid particles to attenuate vibration when an arrow is shot from an archery bow. For example, one conventional bow stabilizer has a hollow body that defines a sealed chamber that is partially filled with granular solids. The bow stabilizer is mounted to the archery bow and has a counterweight that is fixedly adjustable along a longitudinal axis of the elongated hollow body. The hollow body has two end plugs, each end plug having a connecting portion connected to a plug portion. The connecting portion has a peripheral knurled surface to secure the end plug to the hollow body of the bow stabilizer. The end plugs are typically press fitted to the hollow body to contain the granular solids within the hollow body.

Disadvantages associated with the conventional bow stabilizers include leakage of the liquid or solid from the hollow cylinder due to inadequate sealing at the end plugs, the inability to remove end plugs to fill the chamber or to replace the end plugs, and a decrease in bow stabilizer performance, for example as a result of a change in climate. For example, a fluid viscosity may change as the temperature changes, resulting in a decrease in bow stabilizer performance and in bow accuracy.

There is an apparent need for a bow stabilizer having a hollow body forming a chamber to contain a fill and a removeable plug that adequately closes an opening of the hollow body to sealably contain the fill within the chamber.

It is also apparent that there is a need for a sealing device to enlarge or change the shape of a resiliently deformable plug positioned within an opening of a hollow body to close the opening and sealably contain fill within a chamber of the hollow body.

SUMMARY OF THE INVENTION

It is an object of this invention to provide a sealing device for a bow stabilizer to sealably contain a fill within a chamber of a hollow body of the bow stabilizer.

It is another object of this invention to provide a structure or other means for deforming a resilient plug and thereby enlarging an outer surface of the removeably mounted resilient plug, to sealably close an opening in a hollow body of the bow stabilizer.

It is another object of this invention to provide a bow stabilizer having a sealing device mounted with respect to a deformable and resilient plug for closing the at least one opening and sealably containing a fill within a chamber of the hollow body.

The above and other objects of this invention are accomplished with a bow stabilizer for an archery bow having a hollow body, preferably constructed of a suitable, lightweight, rigid material which resists corrosion and deterioration.

At least a portion of the hollow body forms one or more chambers, at least one of which is at least partially filled with a solid and/or a liquid. In one preferred embodiment of this invention, a plug is removeably mounted within each opening of the hollow body to close each opening and sealably contain the fill within the chamber. In one preferred embodiment, the plug is made of a resiliently deformable material that is deformed when a compression force is applied to at least a portion of the plug but preferably returns to its initial shape when the compression force is removed. At least a portion of the hollow body has one or more peripheral grooves at or near the opening to better seal the plug with respect to the hollow body.

The bow stabilizer preferably has a sealing device removeably mounted with respect to the plug, within the at least one opening. The sealing device has two opposing plates forming opposing contact surfaces which are selectively moveable in a direction towards each other or in a direction away from each other.

In one preferred embodiment of this invention, the sealing device has a threaded member, such as a screw, which is rotatably mounted within a bore formed by the plug and mateably engageable with threads of an internally threaded bore of the first plate of the sealing device which is preferably fixed with respect to the first plug. The threaded member also preferably passes through a non-threaded bore in the second plate. As the threaded member is rotated in a first direction, the first plate and the second plate move towards each other, compressing and thus deforming an inner portion of the plug which is positioned within the opening of the hollow body and located between the first plate and the second plate. As the inner portion of the plug is compressed, a given area of the outer surface of the inner portion is enlarged and the inner portion moves radially outward towards and contacts an inner surface of the hollow body to tightly close or seal the plug with respect to the hollow body and sealably contain the fill within the chamber, preventing the fill from leaking through the opening. To remove the plug from the opening of the hollow body, the threaded member is rotated in a second direction, which is preferably opposite the first direction. The first plate and the second plate of the sealing device then move in a direction away from each other and the resilient plug returns to its initial shape.

The plug of this invention can be used to retrofit conventional bow stabilizers, for example to replace a damaged or worn plug that allows the fluid or solid to leak from a conventional bow stabilizer.

BRIEF DESCRIPTION OF THE DRAWINGS

The drawings show different features of a bow stabilizer, according to preferred embodiments of this invention, wherein.

DETAILED DESCRIPTION OF PREFERRED EMBODIMENTS

Figure 1:
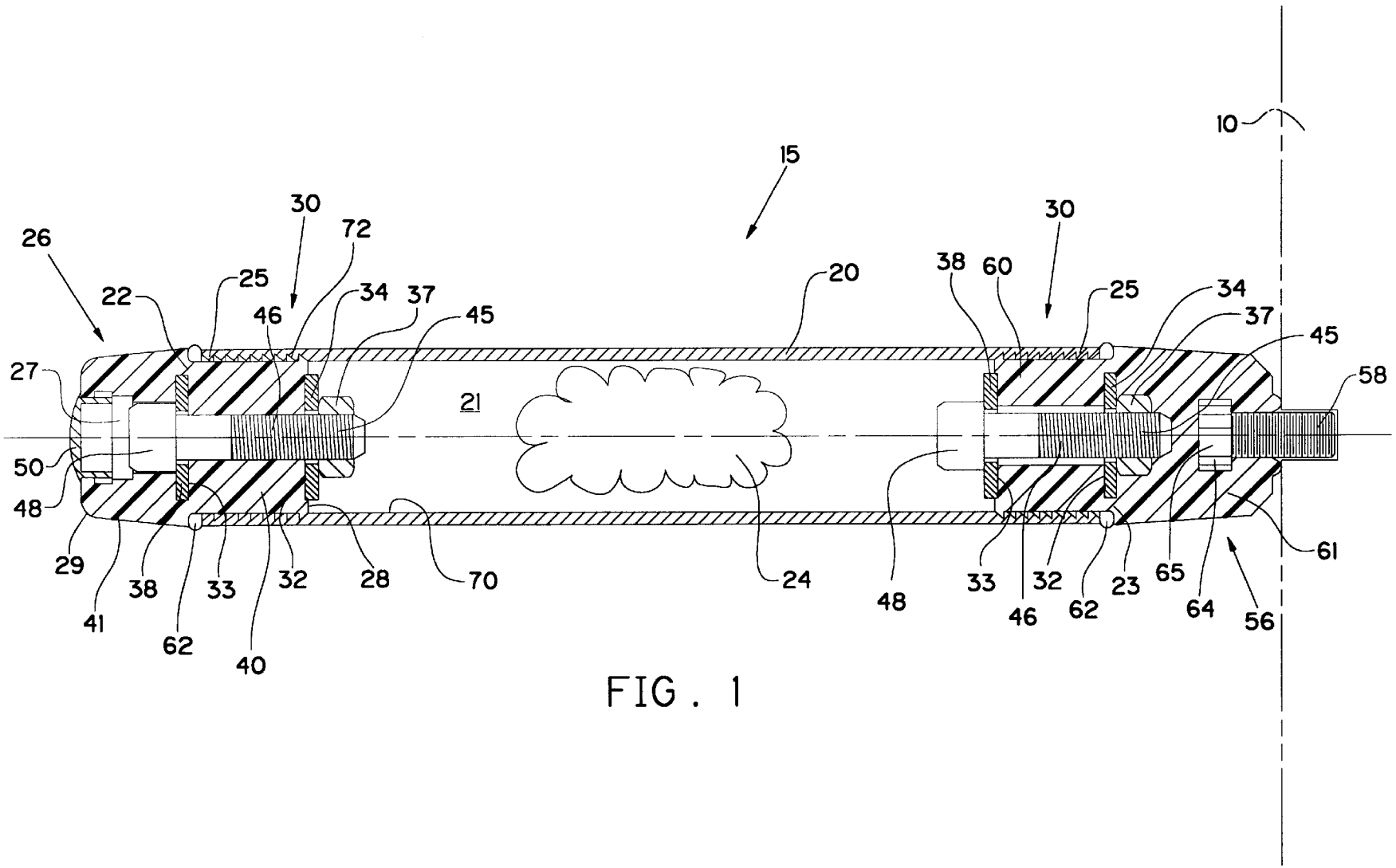
FIG. 1 is a cross-sectional side view of a bow stabilizer, according to one preferred embodiment of this invention.

Referring to FIG. 1, a bow stabilizer 15 for an archery bow 10 comprises a hollow body 20. Preferably, hollow body 20 is constructed of a lightweight, rigid material. For example, hollow body 20 may be constructed of metal, metal alloy, plastic, fiberglass, any suitable composite and the like. Preferably, the material selected for hollow body 20 is one which resists corrosion and deterioration. A bow stabilizer is disclosed in U.S. Pat. No. 5,016,602, the disclosure of which is incorporated in this specification by reference.

Figure 2B:
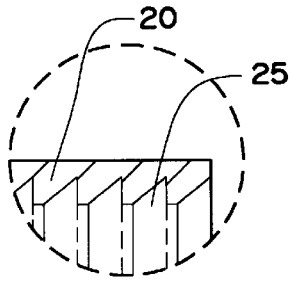
FIG. 2*b* is an enlarged view of a portion, as shown by the dashed circle in FIG. 2*a*, of an opening of a hollow body having a plurality of peripheral grooves, according to one preferred embodiment of this invention.
Figure 2A:
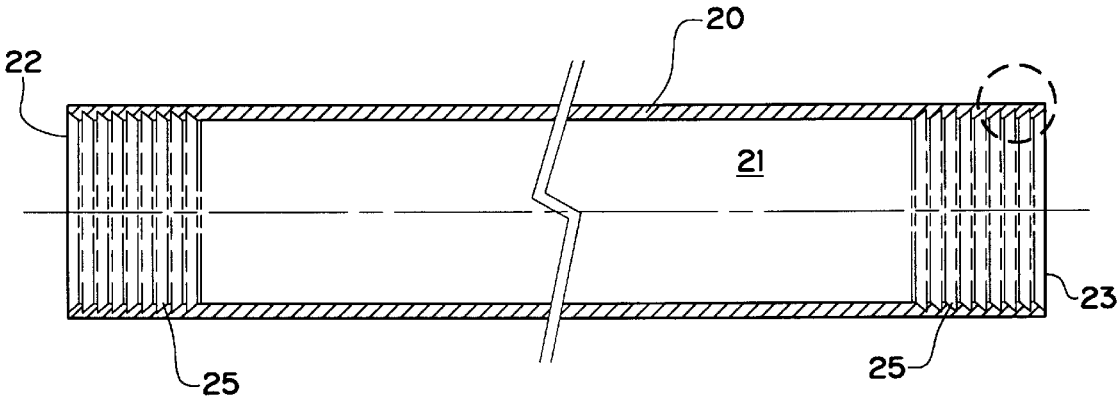
FIG. 2*a* is a cross-sectional side view of a hollow body of a bow stabilizer having peripheral grooves at or near each of a first opening and a second opening of the hollow body, according to one preferred embodiment of this invention.

Preferably, hollow body 20 is tubular. Hollow body 20 preferably but not necessarily has a generally circular internal cross section, as shown in FIG. 2. Hollow body 20 may have any other suitable shape. For example, hollow body 20 may have an overall tapered shape or hollow body 20 may be necked down in a mid region. Further, hollow body 20 may have other suitable non-circular internal cross-sectional shapes, such as a triangular shape, a rectangular shape or any other non-circular shape.

At least a portion of hollow body 20 defines or forms a chamber 21. Chamber 21 is at least partially filled with a fill 24 comprising at least one solid and/or at least one liquid. Suitable solids include, for example, sand, crushed stone, plastic particles, ceramic particles, metal particles and any other suitable material or other granular solids that transfers energy when the solids move against an inner wall of hollow body 20 and/or against each other. Preferably, suitable solids comprise particles of generally average size. The term average size as used throughout this specification and the claims means that the shapes and diameters of particles may vary, but that the individual particle shapes and diameters should not be grossly disproportionate to one another.

Suitable liquids include, for example, water, glycol solution, oil and hydraulic fluid. Preferably, any liquid within hollow body 20 should be able to withstand the climate in which bow stabilizer 15 is anticipated to be used. Fill 24 is preferably designed so that any change in a liquid viscosity as the temperature changes will not negatively affect the performance of bow stabilizer 15 according to this invention.

In one preferred embodiment of this invention, hollow body 20 comprises at least one first opening 22. As shown in FIGS. 1 and 2, opening 22 is formed at two opposing end portions of hollow body 20. However, opening 22 can be formed in any other location on hollow body 20 as shown in FIG. 1 or on any other suitably shaped hollow body 20.

A first plug 26 is removeably mounted or positionable within first opening 22. As used throughout this specification and in the claims, the word plug is intended to be interchangeable with the word cap. In one preferred embodiment of this invention, first plug 26 occupies and closes first opening 22 so that fill 24 is prevented from leaking from chamber 21. Thus, first plug 26 sealably contains at least one solid and/or at least one liquid comprising fill 24 within chamber 21. As shown in FIG. 1, at least a portion of first plug 26 has an outer surface 72 having a peripheral shape that corresponds to the shape of internal surface 70 of hollow body 20. The peripheral shape of outer surface 72 of first plug 26 in one manner corresponds to internal surface 70 by an area of outer surface 72 intimately contacting internal surface 70 and thereby forming a tight seal between first plug 26 and hollow body 20. First plug 26 may have a chamfered edge 29 to prevent any sharp edges.

Preferably, but not necessarily, at least a portion of hollow body 20 has a plurality of peripheral grooves 25 at or near first opening 22 to enhance the seal between first plug 26 and internal surface 70, as shown in FIGS. 1 and 2. Peripheral grooves 25 may comprise conventional threads or any suitable projections and/or indentations that form an irregular or roughened surface. Similarly, at least a portion of first plug 26 may have peripheral grooves 25 alone or corresponding to the peripheral grooves 25 of hollow body 20.

A sealing means, for example a gasket or an O-ring 62, may be positioned between hollow body 20 and first plug 26, as shown in FIG. 1. Preferably, O-ring 62 is made of natural or synthetic rubber, a polymeric material or any other suitable material. O-ring 62 can be used to enhance the seal between first plug 26 and hollow body 20, to sealably contain fill 24 within chamber 21. In another preferred embodiment of this invention, the sealing means comprise a suitable adhesive material or layer between first plug 26 and hollow body 20. For example, an adhesive can be applied, such as in a coating or a layer form, to outer surface 72 and/or to internal surface 70.

First plug 26 is made of a resiliently deformable material. The term resiliently deformable material as used throughout this specification and in the claims means any suitable material having appropriate resilience and deformability so that first plug 26 is easily compressible and thus deformable when a compression force is applied to at least a portion of first plug 26 but returns to an initial shape when the compression force is removed. First plug 26 can be constructed of a polymeric material, a natural or synthetic rubber material, a composite material or any other suitable resiliently deformable material. Because it is resilient, first plug 26 is easily removeable from within first opening 22.

Bow stabilizer 15 further comprises a means for enlarging an outer surface of first plug 26. The means for enlarging may comprise a mechanical device or pneumatic device, for example an expandable bladder or other controllable device, that can be used to enlarge outer surface 72 of first plug 26 in a radially outward or peripheral direction.

In one preferred embodiment of this invention, bow stabilizer 15 comprises a sealing device 30 mounted with respect to first plug 26 and adjustably moveable between a first position and a second position. Outer surface 72 of first plug 26 in the second position is enlarged with respect to outer surface 72 of first plug 26 in the first position.

As shown in FIG. 1, sealing device 30 comprises at least a first contact surface 32 and an opposing second contact surface 33. First contact surface 32 and second contact surface 33 are selectively or controllably moveable in a direction towards each other and in a direction away from each other. At least a portion of first plug 26 is positioned between first contact surface 32 and second contact surface 33.

Figure 5A:
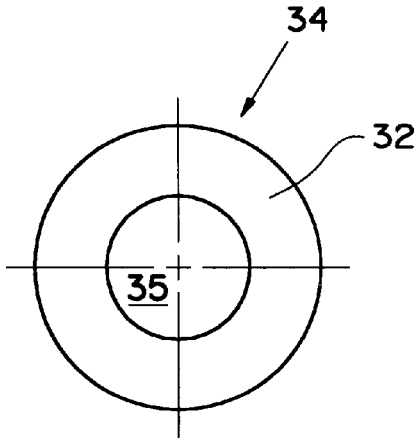
FIG. 5*a* is front view of a first plate that forms a first contact surface, according to one preferred embodiment of this invention.
Figure 5B:
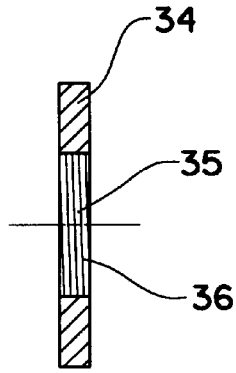
FIG. 5*b* is a cross-sectional side view of the first plate forming the first bore having internal threads, as shown in FIG. 5*a*, according to one preferred embodiment of this invention.
Figure 6A:
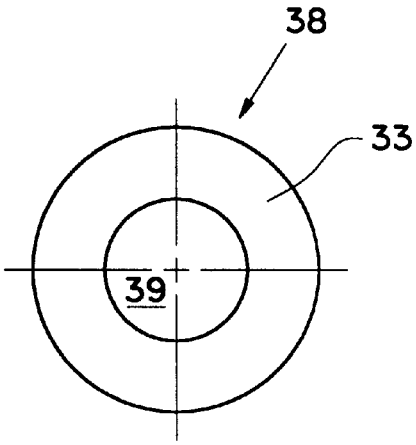
FIG. 6*a* is front view of a second plate that forms a second contact surface, according to one preferred embodiment of this invention.
Figure 6B:
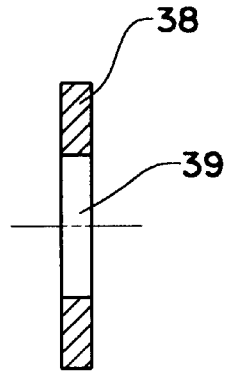
FIG. 6*b* is a cross-sectional side view of the second plate forming the second bore, such as shown in FIG. 6*a*, according to one preferred embodiment of this invention.
Figure 7B:
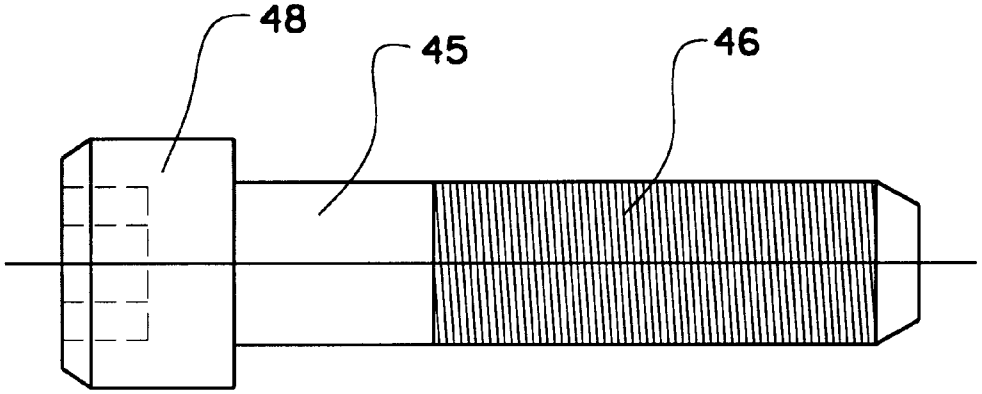
FIG. 7*b* is a side view of the threaded member shown in FIG. 7*a*, such as a plug screw, according to one preferred embodiment of this invention.
Figure 7A:
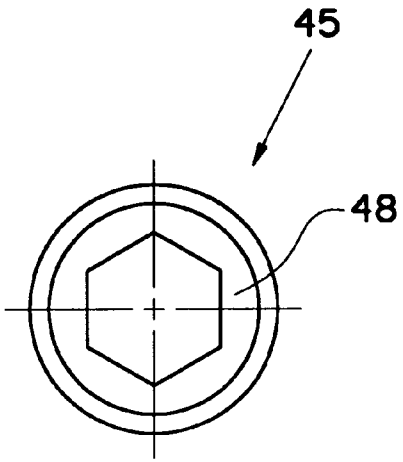
FIG. 7*a* is a front view of a threaded member, such as a plug screw, according to one preferred embodiment of this invention.

In one preferred embodiment of this invention, sealing device 30 comprises a first plate 34 forming first contact surface 32 and an opposing second plate 38 forming second contact surface 33. Either or both of first plate 34 and second plate 38 may be formed by or comprise a nut, a washer or any other suitable material that is preferably but not necessarily flat. As shown in FIGS. 5*a* and 6*a* respectively, first plate 34 forms a first bore 35 and second plate 38 forms a second bore 39. Preferably, but not necessarily, first bore 35 is exposed to internal threads 36 of first plate 34, as shown in FIG. 5*b*. In one preferred embodiment of this invention, first plate 34 and second plate 38 have a generally circular outer periphery, but first plate 34 and/or second plate 38 may have any other suitably shaped outer periphery.

Figure 3A:
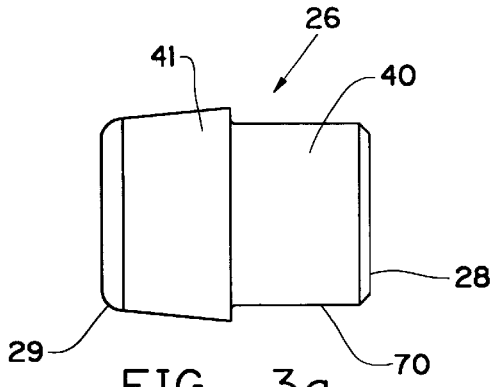
FIG. 3*a* is a side view of a plug, according to one preferred embodiment of this invention.
Figure 3B:
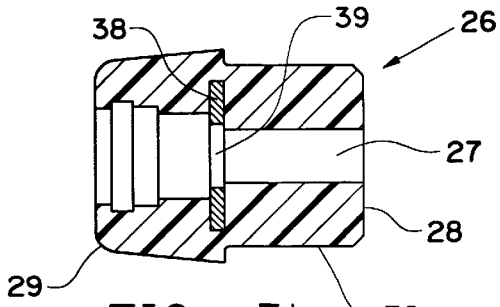
FIG. 3*b* is a cross-sectional side view of the plug such as shown in FIG. 3*a*, having a third bore and a plate, according to one preferred embodiment of this invention.

A threaded member 45, for example a plug screw or a conventional screw, is rotatably mounted with respect to first plug 26. Preferably, threaded member 45 is rotatably mounted within a third bore 27, such as shown in FIG. 3*b*, formed by first plug 26. At least a portion of threaded member 45 has external threads 46 to mateably engage with internal threads 36 of first plate 34 that forms internally threaded first bore 35. As shown in FIG. 1, threaded member 45, having a head 48, is rotatably mounted or positioned and recessed within third bore 27. Preferably, third bore 27 is formed having a depression in which second plate 38 is positioned and coaxially aligned with threaded member 45, as shown in FIG. 3*b*. Threaded member 45 mateably engages with first plate 34 positioned against an inner surface 28 of first plug 26. In one embodiment, first plate 34 further comprises a nut 37, as shown in FIG. 1, having internal threads that mate with external threads 46 of threaded member 45. As shown in FIG. 1, head 48 of threaded member 45 is exposed to and accessible from third bore 27 of first plug 26. First plug 26 can have any other access bore or opening exposed to head 48 or any other element that requires movement.

As threaded member 45 is rotated in a first direction, first plate 34 and second plate 38 move towards each other, compressing and thus deforming an inner portion 40, shown in FIG. 1, of first plug 26, positioned within hollow body 20 and between first plate 34 and second plate 38. As portion 40 of first plug 26 is compressed, outer surface 72 of portion 40 of first plug 26 is enlarged and forced towards inner surface 70 of hollow body 20 to tightly close or seal first opening 22 and sealably contain fill 24 within chamber 21. An outer portion 41 of first plug 26 may or may not be compressed and thus deformed as threaded member 45 is rotated in the first direction, depending on the position of first plate 34 and second plate 38.

A cap 50 can be positioned within third bore 27 to prevent moisture, dirt or other debris from entering third bore 27. To remove first plug 26 from first opening 22, threaded member 45 is rotated in a second direction, which is preferably opposite the first direction. First plate 34 and second plate 38 move away from each other, and the compression force applied to first plug 26 is removed. Then, first plug 26 returns to its initial shape, relatively loose within first opening 22, and is easily removeable from first opening 22.

In one preferred embodiment of this invention, as shown in FIG. 1, hollow body 20 comprises a second opening 23. At least a portion of resiliently deformable second plug 56, which can be the same as or similar to first plug 26, is removeably mountable or positionable within second opening 23 to close second opening 23 and sealably contain fill 24 within chamber 21.

Figure 8:
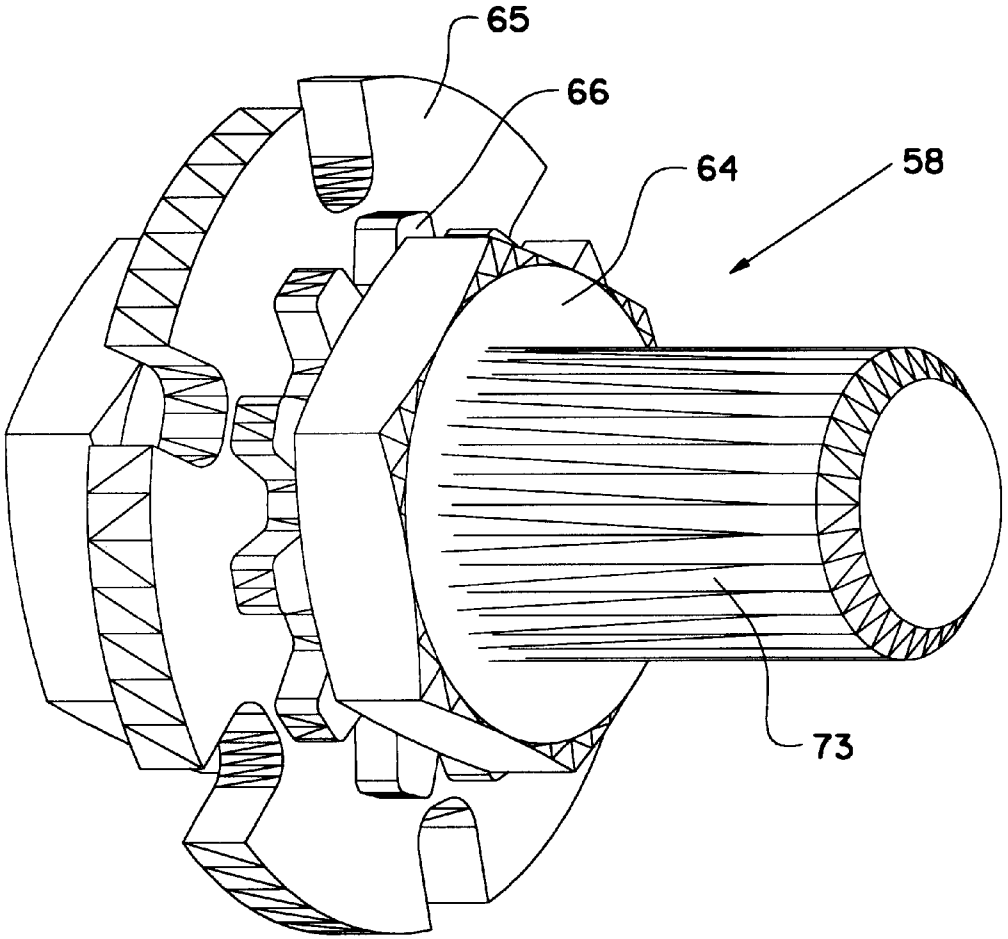
FIG. 8 is a perspective schematic view of a threaded member with a head having a plurality of first projections and a plurality of second projections, according to one preferred embodiment of this invention.

As shown in FIG. 1, a second threaded member 58, for example a plug screw or a conventional screw, is mateable with a threaded female coupling of archery bow 10 to secure bow stabilizer 15 to archery bow 10. In one preferred embodiment of this invention, as shown in FIG. 8, second threaded member 58 comprises external screw threads 73, shown schematically in FIG. 8, a head 64 having a plurality of first projections 65 extending radially outward from head 64. Preferably but not necessarily, a plurality of second projections 66 also extend radially outward from head 64. Second projections 66 can have approximately the same dimensions as first projections 65 or second projections 66 may have different dimensions than first projections 65. During the manufacturing process of second plug 56, the resilient deformable material contacts the outer surface of first projections 65 and secondary projections 66 and binds to the outer surface. The configuration of and spaces between first projections 65 and second projections 66 expose more surface area of threaded member 58 and thus increase a material bond between threaded member 58 and second plug 56. Thus, head 64 can withstand the applied torque necessary to tightly secure bow stabilizer 15 to archery bow 10 because the increased area of material bond strengthens the fixation, such as an injection molded fixation, between second plug 56 and second threaded member 58.

As shown in FIG. 1, head 64 is spaced from threaded member 45 and material of plug 64 is positioned within a formed space 73. The separation and/or the material within space 73 enhances the shock absorbing plugabilities of bow stabilizer 15, according to this invention.

Figure 4A:
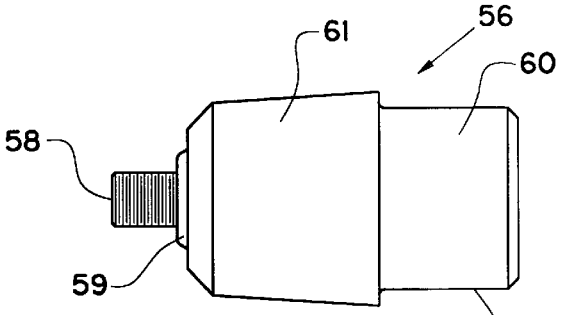
FIG. 4*a* is a side view of a plug having a threaded shaft to secure the bow stabilizer to an archery bow, according to one preferred embodiment of this invention.
Figure 4B:
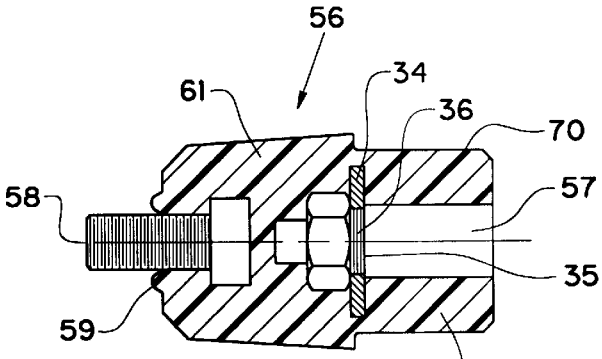
FIG. 4*b* is a cross-sectional side view of the plug such as shown in FIG. 4*a*, having a plate forming a bore with internal threads, according to one preferred embodiment of this invention.

Preferably, but not necessarily, second plug 56 comprises a crush rib or projection 59, as shown in FIGS. 4*a* and 4*b*, that can be compressed between second plug 56 and archery bow 10 to ensure that bow stabilizer 15 is tightly secured with respect to archery bow 10. Preferably, projection 59 has a ring shape and is coaxially positioned about second threaded member 58. At least a portion of second plug 56 has an outer surface having a shape that corresponds to the shape of second opening 23. Second plug 56 may have a chamfered edge 29 to prevent any sharp edges.

Preferably, but not necessarily, at least a portion of hollow body 20 has a plurality of peripheral grooves 25 at or near second opening 23 to tightly secure second plug 56 within second opening 23, as shown in FIGS. 1 and 2. O-ring 62 may be interposed between hollow body 20 and second plug 56 to better contain fill 24 within chamber 21, as shown in FIG. 1. Sealing device 30 is mounted with respect to second plug 56 wherein an inner portion 60 of second plug 56 is positioned between first plate 34 forming first contact surface 32 and opposing second plate 38 forming second contact surface 33.

Threaded member 45 is rotatably mounted with respect to second plug 56. Preferably, threaded member 45 is rotatably mounted within a fourth bore 57 formed by second plug 56. Threaded member 45 has external threads 46 mateably engageable with internal threads 36 of first plate 34 that forms internally threaded first bore 35. As shown in FIG. 1, at least a portion of threaded member 45, having head 48, is rotatably mounted or positioned within fourth bore 57. Preferably, fourth bore 57 has a depression in which first plate 34 is positioned, preferably coaxially aligned with threaded member 45. Threaded member 45 mateably engages with first plate 34 positioned within second plug 56. In one embodiment, first plate 34 further comprises a nut 37 having internal threads to securely mate first plate 34 with threaded member 45. As threaded member 45 is rotated in the first direction, first plate 34 and second plate 38 move towards each other, compressing and thus deforming inner portion 60 of second plug 56 positioned between first plate 34 and second plate 38. As second plug 56 is compressed, outer surface 72 of portion 60 is enlarged and forced towards inner surface 70 of hollow body 20 to tightly close or seal second opening 23 and sealably contain fill 24 within chamber 21. An outer portion 61 of second plug 56 may or may not be compressed and thus deformed as threaded member 45 is rotated in the first direction. Second plug 56 is easily removeable from second opening 23 by rotating threaded member 45 in the second direction, similar to removing first plug 26.

In one preferred embodiment of this invention, first plug 26 and second plug 56 can be used to retrofit conventional bow stabilizers. For example, first plug 26 can be positioned or mounted within a threaded opening of a conventional bow stabilizer. As sealing device 30 is operated by rotating threaded member 45, inner portion 40 of first plug 26 is compressed against an inner wall of the conventional bow stabilizer and between adjacent threads to sealably contain fill 24 within the bow stabilizer.

Figure 9:
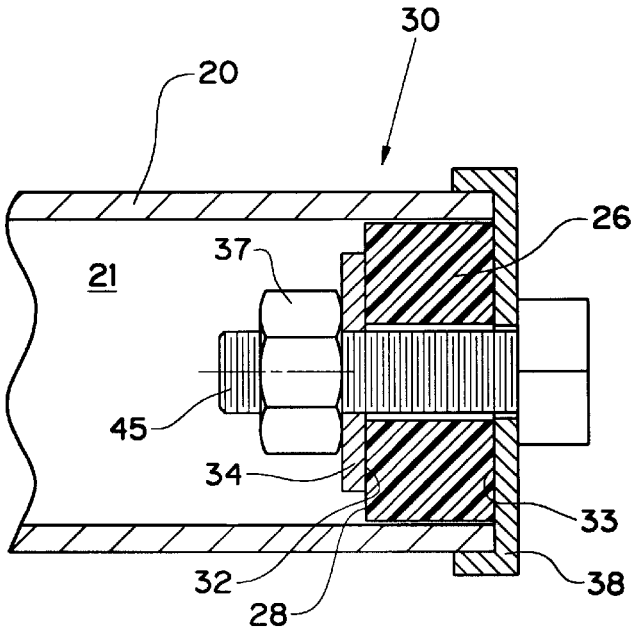
FIG. 9 is a cross-sectional partial side view of a plug according to another preferred embodiment of this invention.

FIG. 9 shows another preferred embodiment of first plug 26 mounted within first opening 22. As shown in FIG. 9, threaded member 45 comprises nut 37 and a bolt. Also as shown in FIG. 9, second contact surface 33 is formed as an inside surface of second plate 38 of a cap that fits over first opening 22.

Figure 10:
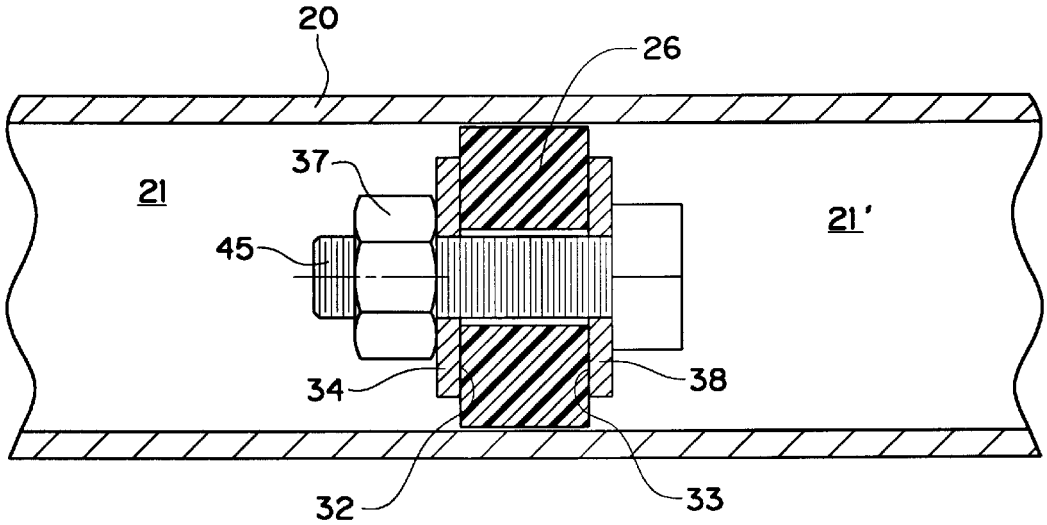
FIG. 10 is a cross-sectional partial side view of a plug according to still another preferred embodiment of this invention.

FIG. 10 shows still another preferred embodiment of first plug 26 positioned within first opening 22 of hollow body 20 and forming two chambers 21 and 21'. It is apparent that one or more first plugs 26 can be used as a partition to form two or more isolated chambers 21, 21'.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. In a bow stabilizer for an archery bow, the bow stabilizer having a hollow body forming a chamber, the hollow body having at least one opening, and a plug closing the at least one opening to seal the chamber, the improvement comprising:

the plug positionable within the at least one opening, a sealing device having a plurality of contact surfaces, at least two of the contact surfaces opposing each other, and the opposing contact surfaces selectively moveable toward each other to deform at least a portion of the plug positioned between the opposing contact surfaces.

2. In the bow stabilizer according to claim 1 wherein the hollow body is tubular.

3. In the bow stabilizer according to claim 2 wherein the tubular hollow body has a generally circular internal cross section.

4. In the bow stabilizer according to claim 1 wherein an outer surface of the plug has a first shape that corresponds to a second shape of the at least one opening.

5. In the bow stabilizer according to claim 1 wherein the plug is of a resiliently deformable material.

6. In the bow stabilizer according to claim 1 wherein the sealing device comprises two plates and each said plate forms one of the opposing contact surfaces.

7. In the bow stabilizer according to claim 6 wherein the sealing device further comprises a threaded member rotatably mounted with respect to the plug, a first plate of the plates having an internally threaded first bore, a second plate of the plates having a second bore, and external threads of said threaded member mateably engaging with internal threads of said first plate that forms said internally threaded first bore.

8. In the bow stabilizer according to claim 7 wherein the plug has a third bore and said threaded member is rotatably mounted within said third bore.

9. In the bow stabilizer according to claim 8 wherein said threaded member comprises a plug screw.

10. In the bow stabilizer according to claim 9 wherein a head of said plug screw is exposed to and accessible from said third bore of the plug.

11. In the bow stabilizer according to claim 7 wherein said first plate comprises a nut.

12. In the bow stabilizer according to claim 7 wherein said threaded member is a screw.

13. In the bow stabilizer according to claim 1 wherein at least a portion of an inner surface of said hollow body has at least one peripheral groove.

14. In the bow stabilize according to claim 1 further comprising a second threaded member mounted with respect to said plug, a head of said second threaded member having a plurality of projections extending in a radially outward direction, and said plug encasing said head and said projections.

15. In the bow stabilizer according to claim 1 wherein the chamber is at least partially filled with at least one of a solid and a liquid.

16. In the bow stabilizer according to claim 15 wherein the sealing device sealably contains the at least one of the solid and the liquid within the chamber.

17. In a bow stabilizer for an archery bow, the bow stabilizer having a hollow body forming a chamber at least partially filled with at least one of a solid and a liquid, the hollow body having a plurality of openings, and a plurality of plugs wherein each of the plugs is mounted within one of the openings to sealably contain the at least one of the solid and the liquid within the chamber, the improvement comprising:

each of the plugs removably mounted within a corresponding one of the openings;

each of the plugs having two plates forming opposing contact surfaces; a plurality of threaded members, each said threaded member rotatably mounted with respect to a corresponding plug of the plugs, a first plate of said plates having an internally threaded first bore, a second plate of said plates having a second bore, and each said threaded member passing through a respective second bore of a respective second plate, external threads of each of said threaded members mateably engageable with internal threads of a respective said first plate that forms said internally threaded first bore, at least a portion of the corresponding plug positioned between said opposing contact surfaces, whereby rotation of each threaded member causes the contact surfaces of its associated plates to move toward each other to deform at least a portion of the plug positioned between the opposing contact surfaces.

18. In the bow stabilizer according to claim 17 wherein the plug is of a resiliently deformable material.

19. In a bow stabilizer for an archery bow, the bow stabilizer having a tubular body forming a chamber and at least one opening, and a plug mounted within each of the at least one opening to sealably contain at least one of a solid and a liquid, the improvement comprising: the plug removeably mounted within the at least one opening, and means for enlarging an outer surface of the plug to sealably close the at least one opening.

20. In the bow stabilizer according to claim 19 wherein said means for enlarging comprise a sealing device mounted with respect to the plug, said sealing device is adjustably moveable between a first position and a second position, and in said second position said outer surface is enlarged with respect to said outer surface in said first position.

21. In the bow stabilizer according to claim 19 wherein the plug is of a resiliently deformable material.

22. In the bow stabilizer according to claim 19 wherein at least a portion of an inner surface of said hollow body at said at least one opening has at least one peripheral groove.

23. In the bow stabilizer according to claim 19 further comprising a second threaded member mounted with respect to said plug, a head of said second threaded member having a plurality of projections extending in a radially outward direction, and said plug encasing said head and said projections.

24. In the bow stabilizer according to claim 19 wherein the chamber is at least partially filled with at least one of a solid and a liquid.

* * * * *